US006823150B1

(12) United States Patent
Cao et al.

(10) Patent No.: US 6,823,150 B1
(45) Date of Patent: Nov. 23, 2004

(54) BACKUP ROLLER TEMPERATURE PREDICTION AND CONTROL FOR FUSER

(75) Inventors: Jichang Cao, Lexington, KY (US); James D. Gilmore, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 27 days.

(21) Appl. No.: 10/430,761

(22) Filed: May 6, 2003

(51) Int. Cl.[7] ..... G03G 15/20
(52) U.S. Cl. ..... 399/69
(58) Field of Search ..... 399/67, 69, 68

(56) References Cited

U.S. PATENT DOCUMENTS 5,701,554 A 12/1997 Tanaka et al.
6,002,912 A * 12/1999 Takeda ..... 399/68
6,160,973 A * 12/2000 Mui ..... 399/68
6,611,670 B2 * 8/2003 Chen et al. ..... 399/67
6,671,470 B2 * 12/2003 Suzuki et al. ..... 399/69
6,674,978 B1 * 1/2004 Suzuki et al. ..... 399/67

FOREIGN PATENT DOCUMENTS

JP 08314301 A * 11/1996 ..... G03G/15/20
JP 2000112188 A * 4/2000 ..... G03G/15/00

* cited by examiner

*Primary Examiner*—Susan Lee
(74) *Attorney, Agent, or Firm*—Stevens & Showalter, LLP

(57) ABSTRACT

A method of controlling a fuser having a heating member and a pressure member wherein the pressure member temperature is estimated from parameters set by a print engine and measured media throughput. Media throughput is used to determine a predicted pressure member steady temperature (SST) associated with the operating mode of the fuser. The predicted pressure member SST and an estimated pressure member starting temperature are used to calculate a pressure member temperature change, and the calculated temperature change is used to determine an estimated pressure member temperature. The print engine compares the estimated pressure member temperature to a predetermined temperature and reduces the heating member set point temperature if the predetermined temperature is exceeded to avoid the pressure member reaching a maximum temperature.

25 Claims, 5 Drawing Sheets

| HR Setpoint (°C) | Speed (ppm) | Media | Actual Pages Processed (ppm) | Throughput (%) | BUR SS Temp (°C) |
|---|---|---|---|---|---|
| 165 | 10 | 90# Cardstock | 10 | 100 | 70 |
| 165 | 10 | 90# Cardstock | 8 | 80 | 82 |
| 165 | 10 | 90# Cardstock | 6 | 60 | 93 |
| 165 | 10 | 90# Cardstock | 4 | 40 | 102 |
| 165 | 10 | 90# Cardstock | 3 | 30 | 107.5 |
| 165 | 10 | 90# Cardstock | 2 | 20 | 110 |
| 165 | 10 | None | 0 | 0 | 122.5 |
| | | | | | |
| 165 | 10 | Label | 10 | 100 | 49 |
| 165 | 10 | Label | 8 | 80 | 67 |
| 165 | 10 | Label | 6 | 60 | 81 |
| 165 | 10 | Label | 4 | 40 | 93.5 |
| 165 | 10 | Label | 3 | 30 | 101 |
| 165 | 10 | Label | 2 | 20 | 105 |
| 165 | 10 | None | 0 | 0 | 122.5 |
| | | | | | |
| 180 | 10 | Transparency | 10 | 100 | 75 |
| 180 | 10 | Transparency | 8 | 80 | 88.5 |
| 180 | 10 | Transparency | 6 | 60 | 99 |
| 180 | 10 | Transparency | 4 | 40 | 110 |
| 180 | 10 | Transparency | 3 | 30 | 116 |
| 180 | 10 | Transparency | 2 | 20 | 120 |
| 180 | 10 | None | 0 | 0 | 133 |
| | | | | | |
| 165 | 24 | 20# Letter | 24 | 100 | 79 |
| 165 | 24 | 20# Letter | 19 | 79.1 | 93 |
| 165 | 24 | 20# Letter | 14 | 58.3 | 106 |
| 165 | 24 | 20# Letter | 10 | 41.6 | 114 |
| 165 | 24 | 20# Letter | 7 | 29.2 | 119.5 |
| 165 | 24 | 20# Letter | 6 | 25 | 120.5 |
| 165 | 24 | None | 0 | 0 | 133 |
| | | | | | |
| 165 | 24 | 32# Letter | 24 | 100 | 63 |
| 165 | 24 | 32# Letter | 19 | 79.1 | 78 |
| 165 | 24 | 32# Letter | 14 | 58.3 | 98 |
| 165 | 24 | 32# Letter | 10 | 41.6 | 107 |
| 165 | 24 | 32# Letter | 7 | 29.2 | 111 |
| 165 | 24 | 32# Letter | 6 | 25 | 114 |
| 165 | 24 | None | 0 | 0 | 133 |

Fig. 2

| Time (Minutes) | Throughput (%) | $T_{SS}$ (°C) | $\Delta T$ (°C) | $T_C$ (°C) |
|---|---|---|---|---|
| 0 | 100 | 75.0 | --- | 75.0 |
| 1 | 60 | 99.0 | 4.8 | 79.8 |
| 2 | 60 | 99.0 | 3.8 | 83.6 |
| 3 | 60 | 99.0 | 3.1 | 86.7 |
| 4 | 60 | 99.0 | 2.5 | 89.2 |
| 5 | 60 | 99.0 | 2.0 | 99.0 |

Fig. 5

BACKUP ROLLER TEMPERATURE PREDICTION AND CONTROL FOR FUSER

BACKGROUND OF THE INVENTION

1. Field of the Invention

The present invention relates to a method and apparatus for controlling a fusing operation. More particularly, the present invention relates to controlling the temperature of a fuser having a hot roller and a cooperating backup roller to fuse an image onto a media using an estimated temperature of the backup roller.

2. Description of Related Prior Art

In an electrophotographic image forming apparatus, such as a printer or copier, a latent image is formed on a light sensitive drum and developed with toner. The toner image is then transferred onto a medium, such as a sheet of paper, and is subsequently passed through a fuser where heat is applied to melt the toner and fuse it to the medium. The fuser includes a hot fuser roller cooperating with a backup roller to form a nip through which the toned media passes. The hot roller is provided with an internal heater, such as a tungsten-filament lamp, and a temperature sensor for providing a temperature signal to a print engine for controlling the temperature of the fusing operation to a predetermined target temperature. Additionally, in order to facilitate fuser warm-up and temperature control, it is known to provide the backup roller with an internal heater, and to include an additional temperature sensor providing a temperature signal for controlling the temperature of the backup roller. However, in order to minimize the cost of the fuser it is desirable to provide a heater element and temperature sensor for only the hot roller, controlling the power to the heater element of the hot roller to compensate for energy absorbed and given off by the backup roller during operation of the fuser. In any event, accurate control of the fusing temperature to a predetermined target temperature is important in order to meet gloss, fuse grade, transmittance and release requirements for the fusing operation.

Various control techniques have been proposed to compensate for the energy absorbed by the backup roller, as well as to adjust the fusing conditions for heat energy that may be conveyed to the backside of the media from the backup roller during the fusing operation. For example, it is known to control the hot roller of a fuser at an elevated temperature during printing of an initial quantity of media, and then lower the temperature of the hot roller for fusing of subsequent media sheets. Such control provides an initial increased amount of energy as the backup roller heats to a steady state temperature, and then adjusts the temperature of the hot roller for the subsequent fuser operation with the backup roller transferring energy to the media for fusing the later part of a print job having multiple sheets of media. The steady state temperature of the backup roller and the rate at which the backup roller absorbs energy vary depending on the type of media being processed and the throughput of the fuser. For example, heavier media will absorb more energy from the hot roller, resulting in the backup roller temperature rising at a slower rate than for a lighter weight media. Similarly, a higher throughput rate, i.e., smaller gaps between successive media, will reduce the rate of energy transfer to the backup roller, resulting in a lower backup roller steady state temperature. In controlling the print job, the print engine specifies a process speed for a particular job, however, the throughput of media passing through the fuser varies depending various factors including the rate at which the printer's processor can process the image data. For example, a job including a large amount of image data, such as may occur when printing graphic image data, may result in large gaps between successive media sheets producing a low throughput and resulting in a higher steady state temperature.

U.S. Pat. No. 5,701,554 discloses a fixing apparatus including a controller for controlling a target temperature of a heating member and for estimating the amount of heat transferred to a pressurizing member. The pressurizing member cooperates with the heating member to define a nip through which a sheet carrying an unfixed toner image is passed for fusing the toner to the sheet. The temperature of the pressurizing member is indirectly determined based on the amount of electric power supplied to the heating member and the temperature of the heating member, which provides a measure of the amount of heat absorbed from the heating member by the pressurizing member. The temperature of the heating member is considered to deviate from the target temperature in proportion to the amount of heat dissipated from the heating member. This proportional relationship is used to estimate the temperature of the pressurizing member with reference to the temperature of the heating member. The controller uses the estimated temperature of the pressurizing member to adjust the target temperature of the heating member to maintain a desired fixing temperature at the nip.

There remains a need for an effective method and apparatus for controlling the temperature of a fuser having a hot roller and a cooperating backup roller wherein the temperature of only one of the rollers is monitored, and the temperature of the other roller may be accurately estimated to maintain the fuser temperature at a desired value.

SUMMARY OF THE INVENTION

A method of controlling a fuser is provided in which a steady state temperature of a pressure member, such as a backup roller, is estimated for use in controlling the temperature of the fuser. In particular, a throughput of media through the fuser is measured and a corresponding backup roller steady state temperature is predicted for controlling the fuser to avoid exceeding a predetermined maximum temperature for the backup roller.

In accordance with one aspect of the invention, a method is provided for controlling a fuser having a heating member and a pressure member cooperating with the heating member to fuse an image onto a media, the method comprising conveying media through the fuser; detecting a rate at which the media is processed through the fuser; and controlling the fuser in response to the detected processing rate to limit a temperature of the pressure member to a value below a predetermined maximum temperature.

In accordance with another aspect of the invention, a method is provided for controlling a fuser having a heating member and a pressure member cooperating with the heating member to fuse an image onto a media, the method comprising determining a current pressure member temperature; conveying media through the fuser; detecting a rate at which the media is processed through the fuser; determining a predicted steady state temperature for the pressure member based on the detected rate and for a particular mode of operation; calculating a pressure member temperature change for a predetermined time interval; calculating a new estimated pressure member temperature equal to the current pressure member temperature increased or decreased by the pressure member temperature change; and setting the current pressure member temperature equal to the new estimated pressure member temperature and repeating the calculation for a new estimated pressure member temperature.

In accordance with yet a further aspect of the invention, a fuser is provided comprising a heating member; a pressure member cooperating with the heating member to form a nip therebetween for fusing an image onto a media passing through the nip; a detecting element detecting passage of media processed through the nip to provide a detected processing rate; and means for controlling the fuser with reference to the detected processing rate to limit a temperature of the pressure member to a value below a predetermined maximum temperature.

Other features and advantages of the invention will be apparent from the following description, the accompanying drawings and the appended claims.

BRIEF DESCRIPTION OF THE DRAWINGS

FIG. 2 is a table illustrating the variation of the backup roller steady state temperature in relation to a media processing rate for different print modes of operation for the fuser;

FIG. 5 is a table illustrating an example of the backup roller temperatures estimated in accordance with the method of the present application.

DETAILED DESCRIPTION OF THE PREFERRED EMBODIMENT

Figure 1:
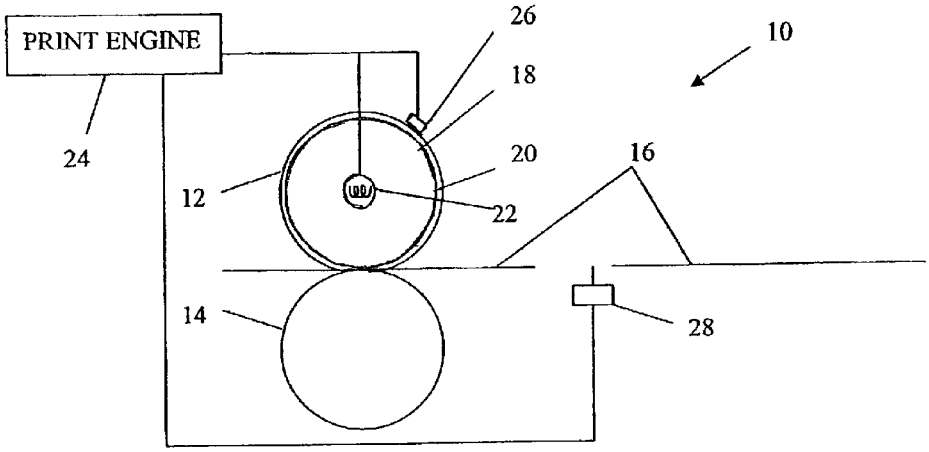
FIG. 1 is a diagrammatic view of a fuser for performing the method of the present application.

Referring to FIG. 1, a fuser 10 for implementing the invention of the present application is diagrammatically illustrated. The fuser 10 includes a hot roller 12 defining a heating member, and a backup roller 14 defining a pressure member cooperating with the hot roller 12 to define a nip for conveying media 16 therebetween. The hot roller 12 may comprise a hollow aluminum core member 18 covered with an elastomeric material layer 20. A heater element 22, such as a tungsten-filament heater, is located inside the core 18 of the hot roller 12 for providing heat energy to the hot roller 12 under control of a print engine controller (hereinafter "print engine") 24. In addition, a temperature sensor 26 is provided for sensing the temperature of the hot roller 12 and for sending a corresponding signal to the print engine 24.

When a new print job is received, the appropriate hot roller set point temperature, the process speed, and media type will be determined by the print engine 24 prior to commencing the printing operation, and the print engine 24 will utilize the signal from the temperature sensor 26 to maintain the hot roller 12 at the desired set point temperature during printing. Further, an exit sensor 28 is provided downstream from the fuser rollers 12, 14 for sensing the passage of successive media 16 passing through the fuser 10 and for providing to the print engine 24 a signal corresponding to successive "breaks" of the sensor 28 (i.e., resulting from media sheets triggering the sensor 28) and "makes" of the sensor 28 (i.e., resulting from gaps between media sheets). The signal from the exit sensor 28 is used by the print engine 24 to determine the actual number of media sheets per unit of time processed through the fuser 10. The print engine 24 uses the actual number of sheets processed to determine a throughput value for the print job. Specifically, the throughput is a percentage of the process speed specified by the print engine 24 for the particular print job, and is calculated by dividing the actual number of pages processed per unit of time by the process speed. For example, if the specified process speed is 24 ppm and there are 12 breaks/makes, corresponding to 12 pages detected by the exit sensor 28 during a 1 minute period, the throughput is 50%.

It should be understood that the actual rate of pages processed, as sensed by the exit sensor 28, may also be expressed in terms of an average gap between successive pages (an average interpage gap), since, for a constant process speed, the size of the interpage gap is directly related to the number of pages passing through the fuser 10. It should further be noted that although the invention of the present application describes determining the throughput based on a signal from the exit sensor 28, information for determining the throughput may also be derived from other process measurements within the printer. For example, a paper pick signal may be used to provide the necessary information for calculating the throughput, based on the number of pages picked from a paper supply.

The correlation between the throughput and the change in backup roller temperature over time is substantially linear for a given media type. The invention of the present application uses this relationship as a basis for estimating the temperature of the backup roller 14. As may be seen in the table of FIG. 2, the steady state temperature of the backup roller 14 is a function of the set point temperature of the hot roller 12, the process speed, the media type and the actual media pages processed in relation to the process speed, i.e., the throughput. The throughput may vary from print job to print job, as well as within a print job, depending on such variables as job size, tray sourcing, the ability of an associated computer or microcontroller to process and transmit data to the print engine, as well as other variables.

Figure 3:
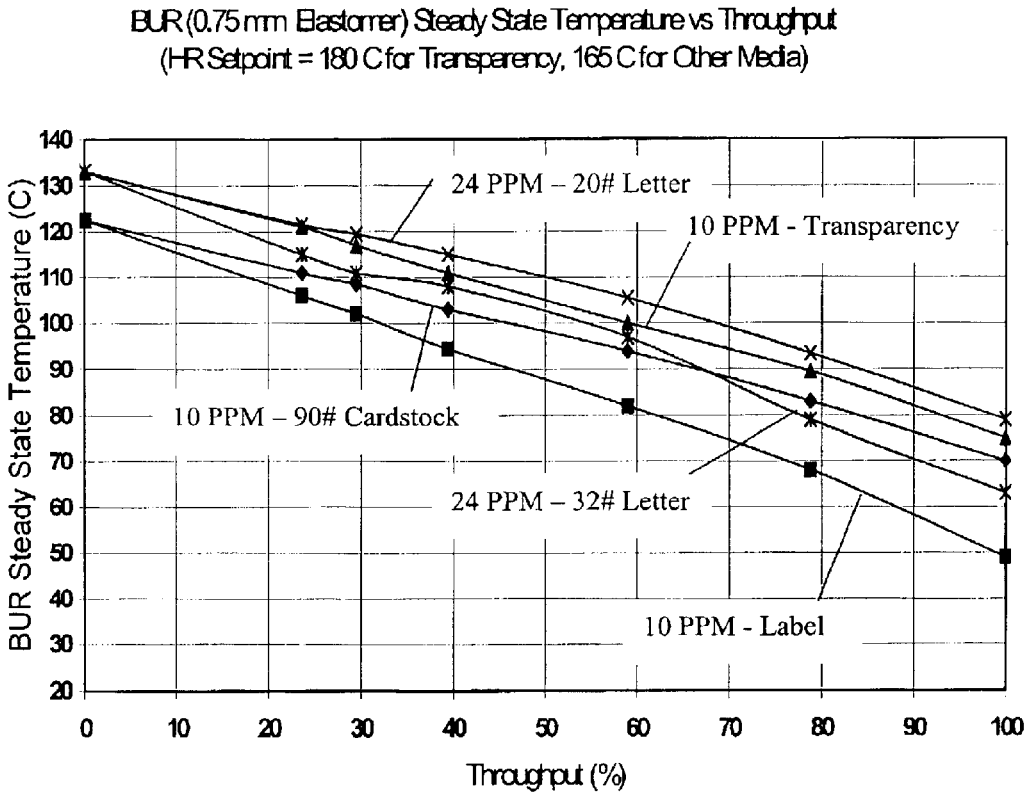
FIG. 3 is a graph illustrating the variation of the backup roller steady state temperature with changes in the rate of processing media through the fuser for different print modes of operation for the fuser.

The relationship between the factors affecting the backup roller steady state temperature is graphically illustrated in FIG. 3, in which it can be seen that the steady state temperature of the backup roller 14 will vary with changes in the throughput of the media, the other factors of set point temperature, media type and process speed being constant for a given print job. Accordingly, after the print engine 24 calculates the throughput from an input signal, e.g., the signal from the exit sensor 28, the relationships illustrated in the graph of FIG. 3 may be used to predict the backup roller steady state temperature in view of the known set point temperature, process speed, and media type.

The predicted backup roller steady state temperature is used in a calculation for estimating the transient temperature of the backup roller 14. Specifically, it is possible to estimate the transient temperature of the backup roller 14 based on a known or estimated starting temperature (a "current" temperature) and a predicted steady state temperature, and further assuming that the backup roller 14 will reach the steady state temperature within a time period equal to or less than a maximum time period. The maximum time period is dependent upon the particular characteristics of the fuser 10 including the thermal characteristics affecting the temperature response of the hot roller 12 and the backup roller 14. For the illustrated fuser 10 of the present application, the maximum time for attaining steady state temperature is assumed to be five minutes.

For the following description, it should be noted that when the fuser 10 is initially warming up ( i.e., after being initially turned on), or warming up from a power saver mode temperature to the standby temperature or to a print temperature, and no media sheets are being processed through the fuser 10, but the hot roller 12 and the backup roller 14 are rotating for at least part of the warmup time, the transient temperature of the backup roller 14 at any given time is estimated based on a known heating rate of the backup roller 14 in relation to a temperature increase of the hot roller 12. Specifically, the temperature of the heating roller 14 is known, for the present example, to increase at a rate of $1^N$ C/second, and the temperature of the backup roller 14 increases at a rate of $0.7^N$ C/second. Similarly, when the temperature of the fuser 10 is decreasing without processing media sheets, and the hot roller 12 and the backup roller 14 are not rotating, the transient temperature of the backup roller 14 is estimated based on a known cooling rate of the backup roller 14. Specifically, the temperature of both the heating roller 12 and the backup roller 14 for the present example decreases at a rate of $6^N$ C/second. Accordingly, for the following description of the backup roller transient temperature, the current temperature, $T_C$, of the backup roller 14, during the times when no media sheets are processed, may be estimated based on the heating or cooling rates of the backup roller 14 as it is heating or cooling for a known time from a known temperature (i.e, heating from room temperature in the power saver mode or after being initially turned on). Alternatively, if the fuser 10 has been in the same mode for a period of time sufficient for attaining a steady state temperature, the initial current backup roller temperature, $T_C$, is set to the attained steady state temperature.

Figure 4:
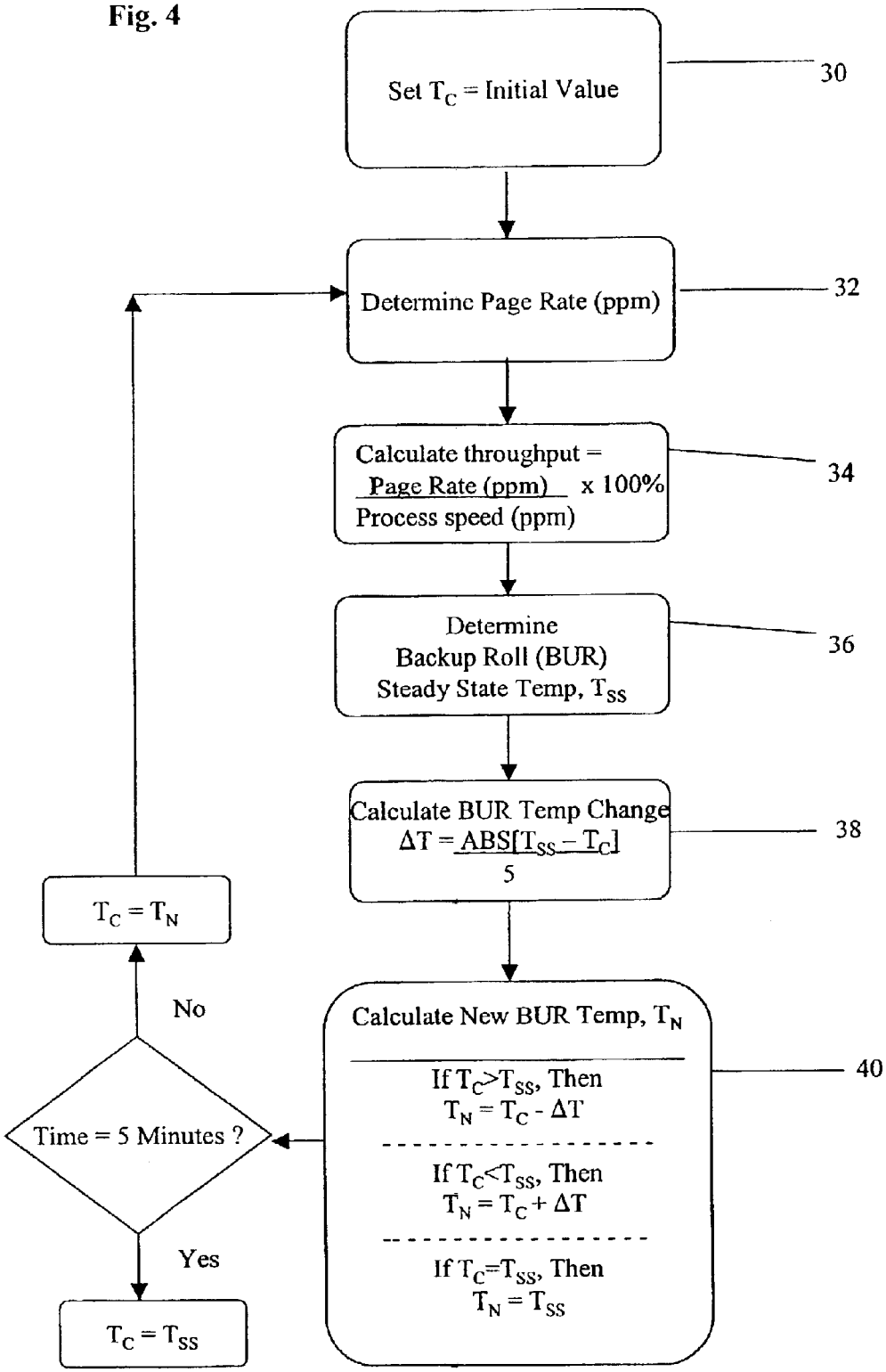
FIG. 4 is a flow diagram illustrating the steps for estimating the backup roller temperature.

Referring to FIG. 4, a flow chart illustrates the steps for estimating the backup roller transient temperature in one minute time increments up to attaining the steady state temperature. The estimation process begins at step 30 by setting an initial value of the current backup roller temperature, $T_C$, determined as described above. At step 32, a measured page rate is determined by measuring the page count for a one minute interval, based on the signal received by the print engine 24 from the exit sensor 28. It should be noted that the print engine 24 is capable of monitoring a signal from the exit sensor 28 every 16 milliseconds; however, in order to reduce processor time for monitoring the exit sensor signal, the exit sensor signal is monitored less frequently. For example, where the minimum interpage gap is approximately 2 inches, the exit sensor signal can be monitored at approximately 500 millisecond intervals to ensure that each interpage gap between media sheets is detected, yet consume minimum processor time.

In step 34, the throughput is determined based on the measured page rate from step 32 relative to the process speed for the job, i.e., if 12 media pages pass through the fuser in 1 minute for a process speed of 24 pages per minute (ppm), the throughput is 50%. The throughput is then used to find the corresponding steady state temperature, $T_{SS}$, at step 36, as illustrated in FIG. 3. It should be noted that in order to reduce processing time, the steady state temperature, $T_{SS}$, may be looked up from a table which correlates discrete throughput values to corresponding steady state temperatures, $T_{SS}$. In this case, the calculated throughput values would be rounded up or down to the nearest tabulated value for the throughput values found in the table. Alternatively, an equation providing steady state temperature values as a function of the throughput value for each of the media (as illustrated in FIG. 3) may be used to calculate the steady state temperatures, $T_{SS}$,.

The steady state temperature, $T_{SS}$, from step 36 is then used in the equation of step 38 to determine the incremental change in temperature, )T, for a one minute time interval. Specifically, the change in temperature, )T, is calculated as the absolute value of the difference between the steady state temperature, $T_{SS}$, and the current backup roller temperature, $T_C$, (from step 30) divided by five. Since the temperature difference is based on a projection of reaching the steady state temperature, $T_{SS}$, within five minutes and the temperature change with time is assumed to be substantially linear, the temperature difference in the calculation of step 36 is divided by five in order to compute the temperature change associated with a one minute increment.

In step 40, a new current backup roller temperature, $T_N$, is calculated using the change in temperature, )T, from step 38. If the current backup roller temperature, $T_C$, is greater than the steady state temperature, $T_{SS}$, then the new backup roller temperature, $T_N$, is set equal to the current backup roller temperature, $T_C$, minus the change in temperature, )T; if the current backup roller temperature, $T_C$, is less than the steady state temperature, $T_{SS}$, then the new backup roller temperature, $T_N$, is set equal to the current backup roller temperature, $T_C$, plus the change in temperature, )T; and if the current backup roller temperature, $T_C$, is equal to the steady state temperature, $T_{SS}$, then the current backup roller temperature, $T_C$, is set equal to the steady state temperature, $T_{SS}$. Further, if the printer has remained in the same mode for five minutes or more, then the current backup roller temperature, $T_C$, is set equal to the steady state temperature, $T_{SS}$, since the backup roller 14 may be assumed to reach the steady state temperature, $T_{SS}$ within a five minute period.

If the printer has not remained in the same print mode for five minutes, at the next one minute increment, the process returns to step 32 to proceed through the steps of calculating a new change in temperature, )T, for the next one minute interval, based on the current measured page rate as determined by the current interpage gap measurement. It should be noted that if the printer goes from one mode to a subsequent mode prior to the five minute interval required for the backup roller 14 to reach the steady state temperature or for the estimated transient backup roller temperature to be set to the steady state temperature, $T_{SS}$, the starting current temperature ($T_C$) for the subsequent mode will be the last new backup roller temperature, $T_N$, calculated for the preceding mode. Additionally, it should be understood that by setting the current temperature, $T_C$, to be equal to the steady state temperature, $T_{SS}$, after operating for five minutes in the same mode, propagation of cumulative errors in the temperature estimation will be minimized since the steady state temperatures may be assumed to be accurate estimations of the backup roller temperature after remaining in a particular mode for five minutes or more.

FIG. 5 is a table providing an example calculation for estimating the transient temperature of the backup roller 14 when the fuser throughput changes from 100% to 60% as the fuser processes transparencies at a process speed of 10 ppm. Assuming that the backup roller 14 has attained its steady state temperature, $T_{SS}$, the initial backup roller temperature is assumed to be the steady state temperature, $T_{SS}$, of $75^N$ C corresponding to 100% throughput. It can be seen that the current temperature, $T_C$, of the backup roller 14 increases incrementally by the amount )T, and approaches the steady state temperature, $T_{SS}$, of $99^N$ C corresponding to 60% throughput over the five minute time interval. Additionally, it should be noted that the table of FIG. 5 shows that the current temperature, $T_C$, is set to the steady state temperature, $T_{SS}$, ($99^N$ C) at the end of the five minute interval.

The backup roller transient temperature estimation may be used to facilitate control of the fusing temperature to ensure the media is fused with consistent quality. As may be seen in the table of FIG. 2, if the fuser rollers 12, 14 are allowed to rotate indefinitely with no media passing through the fuser it is possible for the backup roller temperature to exceed $130^N$ C, as is the case when the set point temperature is $180^N$ C for transparencies. It should be understood that when the backup roller 14 reaches temperatures above a temperature of approximately $120^N$ C, it is necessary to substantially reduce the temperature of the hot roller 12 in order to minimize gloss variation and the possibility of hot offset.

Further, due to the thermal capacity of the elastomeric material layer 20, which in the current application has a thickness of about 0.75 mm, the temperature response of the hot roller 12 is relatively slow, especially when cooling the hot roller 12, and it is preferable to avoid a condition where printing must be delayed for the hot roller 12 to cool. The present backup roller temperature estimation may be used by the print engine 24 to predict the fuser temperature and effect a reduction in power to the hot roller 12 prior to the backup roller 14 reaching approximately $120^N$ C. In particular, when the estimated transient temperature of the backup roller 14 exceeds a temperature of $115^N$ C, the print engine 24 set point is reduced from its normal set point by a predetermined amount of approximately $5^N$ C to $10^N$ C. Thus, the backup roller temperature estimation described herein also provides a prediction of a heated fusing roller temperature, enabling the print engine 24 to adjust the operating parameters of the hot roller 12 prior to the onset of a condition adversely affecting the print quality, such as may occur when the backup roller exceeds approximately $120^N$ C.

As a further control to avoid exceeding an upper limit temperature, such as $120^N$ C, the rotation of the fuser rollers 12, 14 is stopped if the throughput is reduced below approximately 30%. Stopping rotation of the rollers 12, 14 limits the heat transferred from the hot roller 12 to the backup roller 14, thereby allowing the backup roller 14 to cool. As seen in the table of FIG. 2, steady state backup roller temperatures for a throughput of approximately 30% or less may, for certain substrates, exceed $120^N$ C, and this is particularly the case for transparencies and 20# paper media. Discontinuing rotation of the fuser rollers 12, 14 when the throughput falls below 30% avoids delays that could otherwise occur as the hot roller 12 cools to a lower temperature to effect a required temperature reduction of the backup roller 14.

Accordingly, the invention of the present application provides an effective method of controlling a fuser temperature with reference to the gap between successive sheets of media passing through the fuser. The present method is implemented by a print engine including software programmed to predict a steady state temperature for the backup roller and to provide an estimate of the backup roller temperature without reference to a direct temperature measurement of the fuser rollers.

What we claim is:

1. A method of controlling a fuser having a heating member and a pressure member cooperating with said heating member to fuse an image onto a media, the method comprising:

conveying media through said fuser;

detecting a rate at which said media is processed through said fuser; and controlling said fuser in response to said detected processing rate to limit a temperature of said pressure member to a value below a predetermined maximum temperature.

2. The method of claim 1 wherein said temperature of said pressure member is an estimated temperature determined with reference to said detected processing rate.

3. The method of claim 2 wherein said estimated temperature of said pressure member is determined without reference to a measured temperature of said fuser.

4. The method of claim 2 wherein a set point temperature of said heating member is decreased when said estimated temperature of said pressure member is greater than a predetermined temperature.

5. The method of claim 2 including the step of calculating a temperature change of said pressure member and determining said estimated temperature based on said temperature change.

6. The method of claim 5 wherein said step of calculating said temperature change includes determining a predicted steady state temperature for said pressure member, said predicted steady state temperature corresponding to said detected rate at which said media is processed through said fuser.

7. The method of claim 6 wherein said estimated temperature is set to said predicted steady state temperature if said fuser remains in the same mode for a predetermined period of time.

8. The method of claim 1 wherein said detected rate comprises a throughput of an actual number of media sheets passing through the fuser per unit of time relative to a number of media sheets corresponding to a current process speed for the fuser.

9. The method of claim 8 wherein said fuser stops conveying media if said throughput is less than a predetermined value.

10. The method of claim 8 wherein said heating member and said pressure member comprise cooperating rotating rollers, and rotation of said rollers is stopped if said throughput is less than a predetermined value.

11. A method of controlling a fuser having a heating member and a pressure member cooperating with said heating member to fuse an image onto a media, the method comprising:

determining a current pressure member temperature;

conveying media through said fuser;

detecting a rate at which said media is processed through said fuser;

determining a predicted steady state temperature for said pressure member based on said detected rate and for a particular mode of operation;

calculating a pressure member temperature change for a predetermined time interval;

calculating a new estimated pressure member temperature equal to said current pressure member temperature increased or decreased by said pressure member temperature change; and setting said current pressure member temperature equal to said new estimated pressure member temperature and repeating the calculation for a new estimated pressure member temperature.

12. The method of claim 11 including setting said current pressure member temperature equal to said predicted steady state temperature if the amount of time said fuser has been operating in the same mode is equal to or greater than a predetermined period of time.

13. The method of claim 11 including the step of decreasing a set point temperature of said heating member when said new estimated pressure member temperature is greater than a predetermined temperature.

14. The method of claim 11 wherein said calculation of said pressure member temperature change is performed with reference to a difference between said current pressure member temperature and said predicted steady state temperature.

15. The method of claim 11 wherein said step of calculating said new estimated pressure member temperature comprises adding said pressure member temperature change to the current pressure member temperature if said current pressure member temperature is less than said predicted steady state temperature, or subtracting said pressure member temperature change from said current pressure member temperature if said current pressure member temperature is greater than said predicted steady state temperature.

16. The method of claim 11 including the step of changing to a subsequent mode of operation wherein the current pressure member temperature for the subsequent mode of operation is the last new estimated pressure member temperature from the previous mode of operation.

17. The method of claim 11 wherein said step of determining a throughput of said media through said fuser base on a comparison of said detected rate at which said media is processed through said fuser relative to a current process speed for said fuser.

18. The method of claim 17 wherein said fuser stops conveying media if said throughput is below a predetermined value.

19. The method of claim 17 wherein said heating member and said pressure member comprise cooperating rotating rollers, and including the step of stopping rotation of said rollers if said throughput is below a predetermined value.

20. A fuser comprising:

a heating member;

a pressure member cooperating with said heating member to form a nip therebetween for fusing an image onto a media passing through said nip;

a detecting element detecting passage of media processed through said nip to provide a detected processing rate; and means for controlling the fuser with reference to said detected processing rate to limit a temperature of said pressure member to a value below a predetermined maximum temperature.

21. The fuser of claim 20 wherein said means for controlling the fuser determines an estimated temperature of said pressure member.

22. The fuser of claim 21 wherein said heating member is controlled to a set point temperature and said set point temperature is decreased a preset amount when said estimated temperature of said pressure member is greater than a predetermined temperature.

23. The fuser of claim 20 wherein said control means determines a throughput based on said detected processing rate relative to a current process speed for said fuser.

24. The fuser of claim 23 wherein said fuser stops conveying media if said throughput is below a predetermined value.

25. The fuser of claim 23 wherein said heating member and said pressure member comprise cooperating rotating rollers, and rotation of said rollers is stopped if said throughput is below a predetermined value.

* * * * *